US006358100B1

(12) United States Patent
Watanabe et al.

(10) Patent No.: US 6,358,100 B1
(45) Date of Patent: Mar. 19, 2002

(54) ELECTRICAL CONNECTOR

(75) Inventors: Yoshinori Watanabe; Toshitaka Kusuhara, both of Kanagawa (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/557,288

(22) Filed: Apr. 25, 2000

(51) Int. Cl.[7] ..... H01R 13/40
(52) U.S. Cl. ..... 439/733.1
(58) Field of Search ..... 439/733.1, 809, 439/444, 79, 217

(56) References Cited

U.S. PATENT DOCUMENTS 5,221,210 A * 6/1993 Bormuth et al. ..... 439/79
5,667,392 A * 9/1997 Kocher et al. ..... 439/733.1

FOREIGN PATENT DOCUMENTS

JP 9-289053 11/1997 ..... 9/9

* cited by examiner

*Primary Examiner*—P. Austin Bradley
*Assistant Examiner*—Briggitte R. Hammond

(57) ABSTRACT

37 An electrical connector is provided in which the contacts do not slip out of the housing when the mating contacts of the mating connector contact both opposite major surfaces of the contact parts of the contacts, and which is devised so that even in cases where dirt or other members, e.g., housing bodies or electrical parts such as resistors, etc., approach the rear edges of the contacts, there is no short-circuiting of adjacent contacts by such dirt, etc. The electrical connector 1 is equipped with contacts 20 which have contact parts 23 that contact the mating contacts 42 of a mating connector 40 engaged parallel to the circuit board 30 with both opposite major surfaces of a stamped metal plate. The press-fitting fastening parts 22 of the contacts 20 are fastened to the housing 10 by press-fitting from the bottom side of the housing 10 in a direction perpendicular to the engagement direction of the mating connector 40. Substantially the entire rear edge of each contact 20 on the opposite side of the contact 20 from the contact part 23 is covered by the housing 10.

2 Claims, 6 Drawing Sheets

ELECTRICAL CONNECTOR

FIELD OF THE INVENTION

The present invention is directed to an electrical connector in which metal contacts have a press-fitting fastening part that is fastened to a housing by press-fitting, and a contact part which contacts both opposite major surfaces of a stamped mating contact of a mating connector engaged parallel to a circuit board.

BACKGROUND OF THE INVENTION

The electrical connector shown in FIGS. 7A–7C is a conventional electrical connector for engaging a mating connector in a direction parallel to a circuit board on which the electrical connector is mounted (see Japanese Patent Application Kokai No. HEI 9-289053). This electrical connector 100 is equipped with an insulating housing 110 which is mounted on a circuit board (not shown in the figures), and a plurality of contacts 120 which are attached to the housing 110 in a row. Each of the contacts 120 is formed by the stamping of a metal plate, and has a press-fitting fastening part 121 which is fastened to the housing 110 by press-fitting, a contact part 122 which is positioned further forward than the press-fitting fastening part 121, which protrudes from the front surface 111 of the housing 110, and which contacts the mating contact (not shown in the figures) of a mating connector engaged parallel to the circuit board with both opposite major surfaces of the stamped metal plate, and a solder connection part 123 which extends from the rear end portion of the press-fitting fastening part 121, and which is connected by soldering to a through-hole in the circuit board. The press-fitting fastening part 121 has a plurality of projections 121*a* and 121*b* which are formed on the upper and lower shear edges of the stamped metal plate, and which fasten the contact 120 in place by biting into the housing 110. As a result of two points of contact being formed with the mating contact, contact with the mating contact can be securely accomplished even by one side in the direction of thickness of the plate, so that the reliability of this contact can be increased.

However, in the case of this conventional electrical connector 100, the press-fitting fastening parts 121 of the respective contacts 120 are fastened by press-fitting toward the front surface 111 of the housing 110 from the rear surface 112 of the housing 110. Accordingly, when the mating contacts of the mating connector contact both opposite major surfaces of the contact parts 122 of the contacts 120 in the direction extending from the front surface 111 of the housing 110 toward the rear surface 112 of the housing 110, the projections 121*a* and 121*b* of the press-fitting fastening parts 121 may move in cases where the contact force is large. As a result, the contacts 120 may slip out of the housing 110.

Furthermore, the rear edges 124 of the contacts 120 on the opposite sides of the contacts 120 from the contact parts 122 are exposed to the outside from the rear surface 112 of the housing 110. As a result, in cases where dirt or other members, e. g., housing bodies or electrical parts such as resistors, etc., approach the exposed portions of the respective contacts 120 after the solder connection parts 123 have been connected to the circuit board by soldering, adjacent exposed portions may be short-circuited by such dirt, etc.

SUMMARY OF THE INVENTION

Accordingly, one object of the present invention is to provide an electrical connector in which the contacts do not slip out of the housing when the mating contacts of the mating connector contact both opposite major surfaces of the contact parts of the contacts.

Another object of the present invention is to provide an electrical connector which is devised so that even in cases where dirt or other members, e. g., housing bodies or electrical parts such as resistors, etc., approach the rear edges of the contacts, there is no short-circuiting of adjacent contacts by such dirt, etc.

The electrical connector of the present invention comprises an insulating housing that is mounted on a circuit board, and a plurality of contacts that are attached to the housing. Each of the contacts is formed by the stamping of a metal plate, and has a press-fitting fastening part that is fastened to the housing by press-fitting, and a contact part which is positioned further forward than the press-fitting fastening part, and which contacts the mating contact of a mating connector engaged parallel to the circuit board with both opposite major surfaces of the stamped metal plate. The press-fitting fastening parts of the contacts are fastened to the housing by press-fitting from the bottom side of the housing along a direction perpendicular to the direction of engagement of the mating connector, and substantially the entire rear edge of the contacts on the opposite side of the contact from the contact part is covered by the housing.

Furthermore, it is effective if each of the contacts has a solder connection part which is connected by soldering to a through-hole in the circuit board, and solder connection inspection recesses which are located in positions corresponding to the solder connection parts of the contacts, and which extend from the rear surface of the housing to the front surface, are formed in the bottom surface of the housing.

BRIEF DESCRIPTION OF THE DRAWINGS

FIGS. 7A–7C show a prior art electrical connector, wherein FIG. 7A is a plan view, FIG. 7B is a front view, and FIG. 7C is a sectional view along line 7C–7C of FIG. 7B.

DETAILED DESCRIPTION OF THE INVENTION

Figure 1:
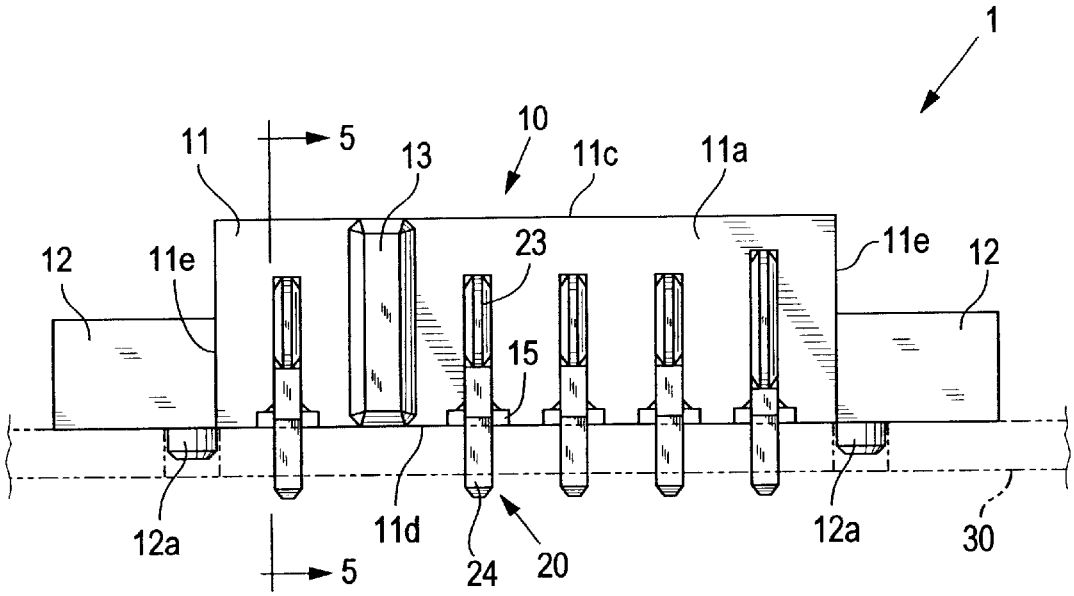
FIG. 1 is a front view of an embodiment of the electrical connector of the present invention.
Figure 2:
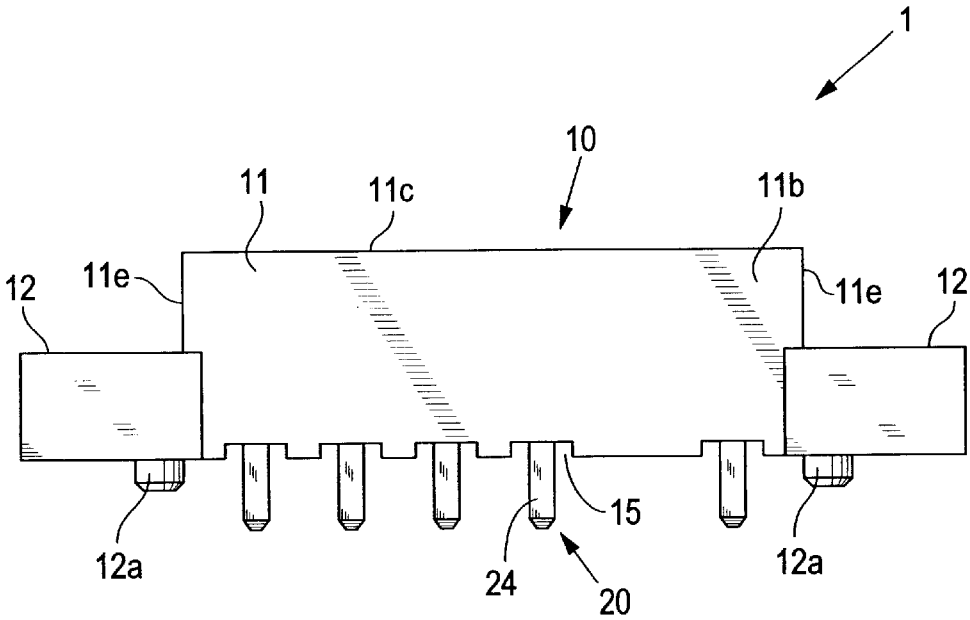
FIG. 2 is a back view of the electrical connector shown in FIG. 1.
Figure 3:
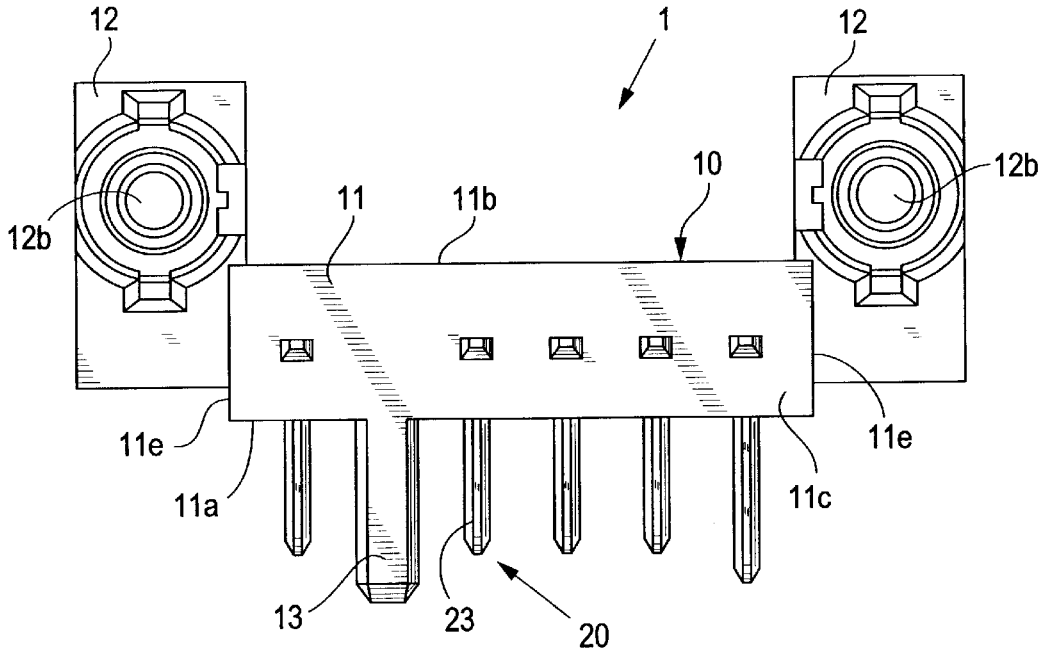
FIG. 3 is a plan view of the electrical connector shown in FIG. 1.
Figure 4:
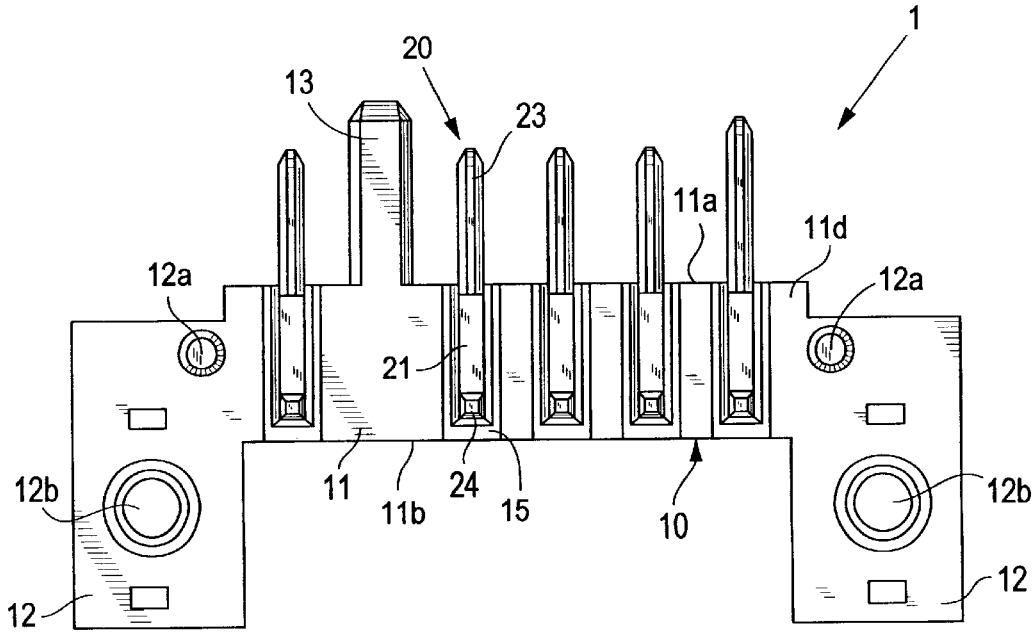
FIG. 4 is a bottom view of the electrical connector shown in FIG. 1.
Figure 5:
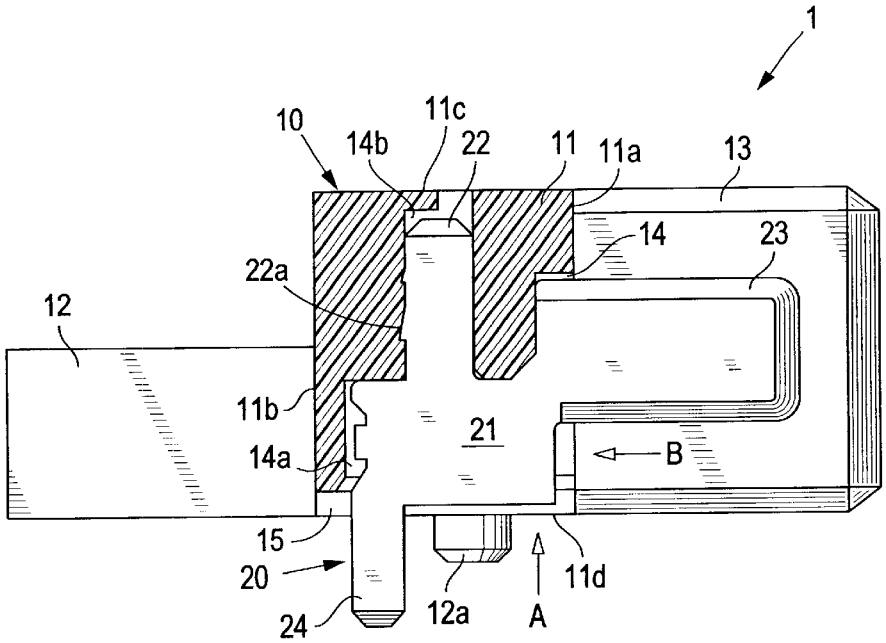
FIG. 5 is a sectional view taken along line 5—5 of FIG. 1.

In FIGS. 1 through 5, the electrical connector 1 is shown equipped with an insulating housing 10 which is mounted on a circuit board 30, and a plurality of contacts 20 which are attached to the housing 10. The housing 10 is formed by molding an insulating resin, and is equipped with a contact mounting part 11 which substantially has the shape of a rectangular solid, and which has a front surface 11*a*, a rear surface 11*b*, a top surface 11*c*, a bottom surface 11*d* and two side surfaces 11*e*, and a pair of board attachment parts 12 which protrude from both side surfaces of the contact mounting part 11. A polarity rib 13 which protrudes forward from the front surface 11*a* is disposed on the contact mounting part 11. This polarity rib 13 prevents backward insertion of the electrical connector 1 during engagement of the electrical connector 1 and mating connector 40. Furthermore, a plurality of contact accommodating holes 14 which are lined up in a single row at a specified pitch are formed in the contact mounting part 11 on both sides of the polarity rib 13. As shown most clearly in FIG. 5, each contact accommodating hole 14 has a base accommodating part 14*a* which accommodates the base part 21 of the corresponding contact 20, and a fastening attachment part 14*b* which extends upward from the base accommodating part 14*a*, and to which the press-fitting fastening part 22 of the corresponding contact 20 is fastened. The base accommodating part 14*a* opens at the front surface 11*a* and bottom surface 11*d* of the contact mounting part 11. Furthermore, positioning bosses 12*a* are formed on the board attachment parts 12 so that these positioning bosses 12*a* protrude downward from the bottom surface, and attachment screw through-holes 12*b* through which attachment screws (not shown in the figures) are passed when the housing 10 is mounted on the circuit board 30 are also formed in the board attachment parts 12.

Figure 6:
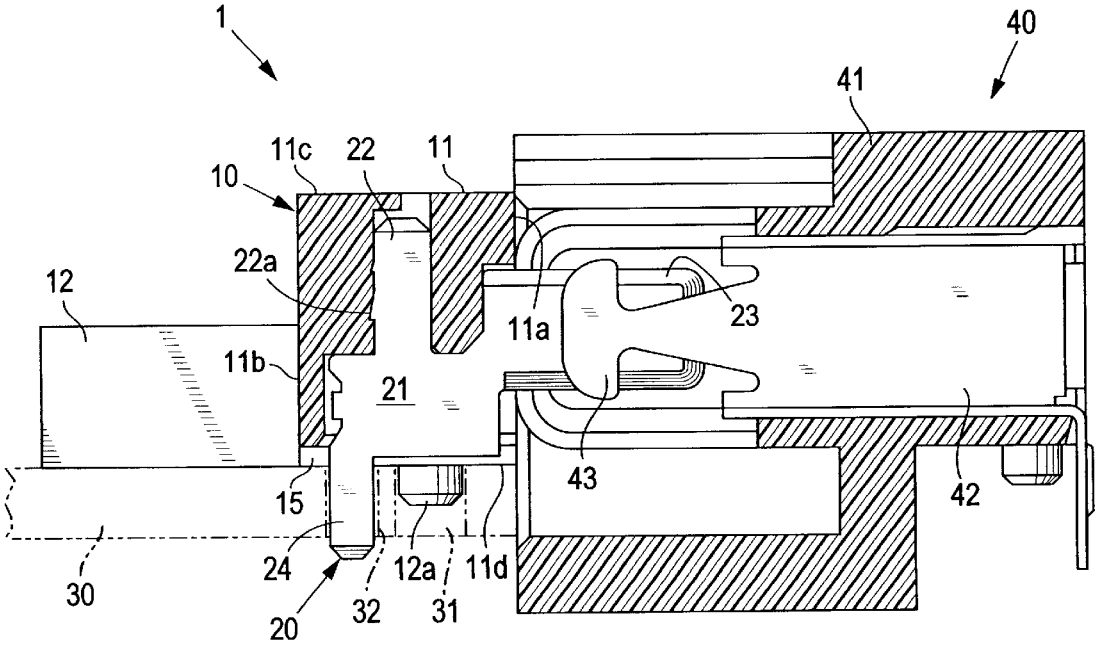
FIG. 6 is a sectional view which shows the state of engagement between the electrical connector shown in FIG. 1 and a mating connector.
Figure 7A:
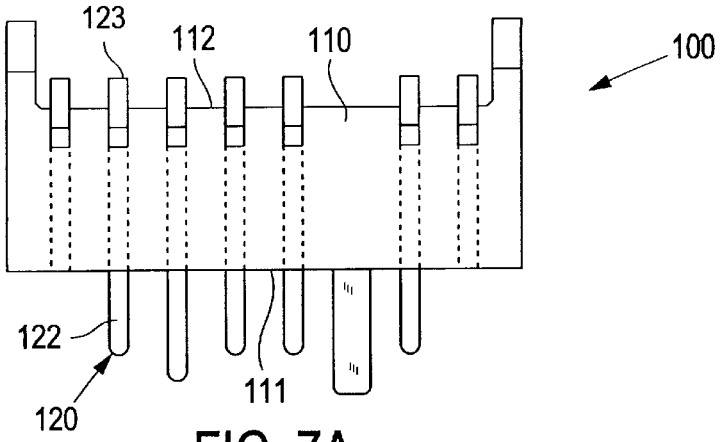
FIG. 7A PRIOR ART
Figure 7B:
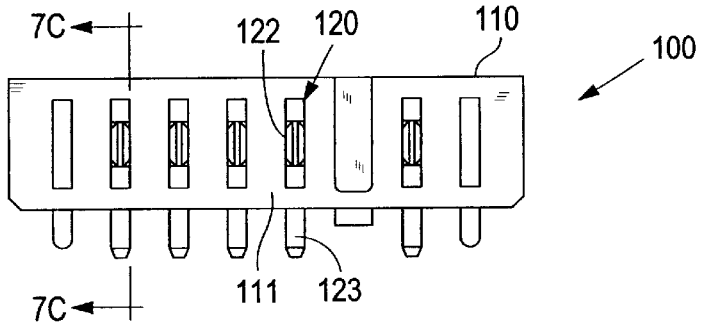
FIG. 7B PRIOR ART
Figure 7C:
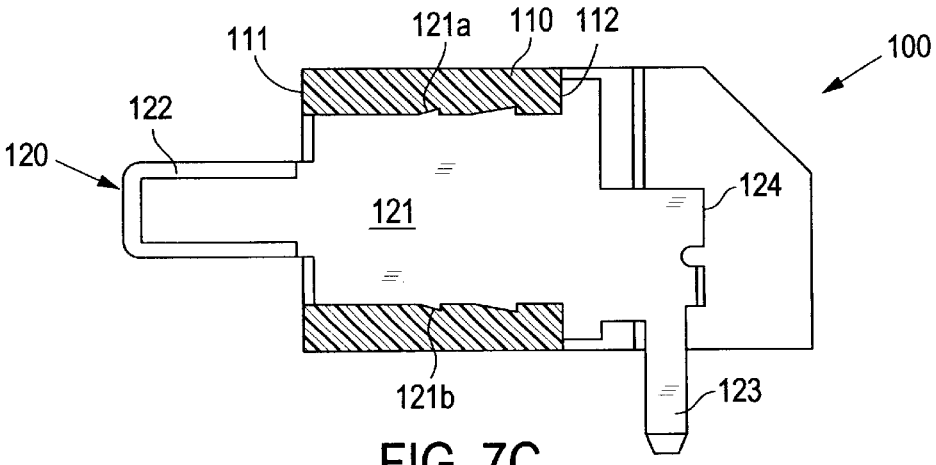
FIG. 7C PRIOR ART
Figure 8:
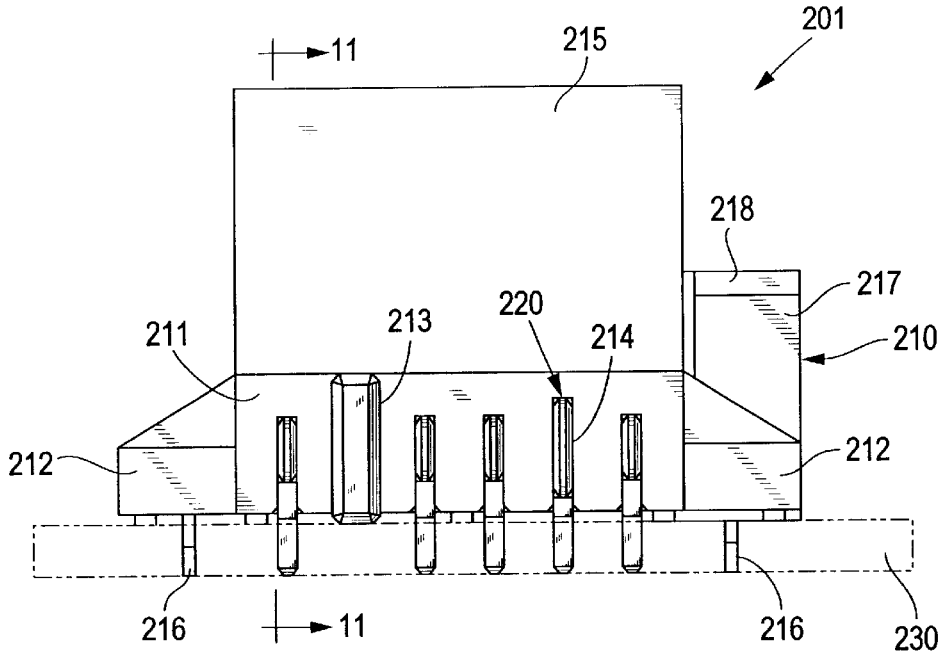
FIG. 8 is a front view of a second embodiment of the electrical connector of the present invention.
Figure 9:
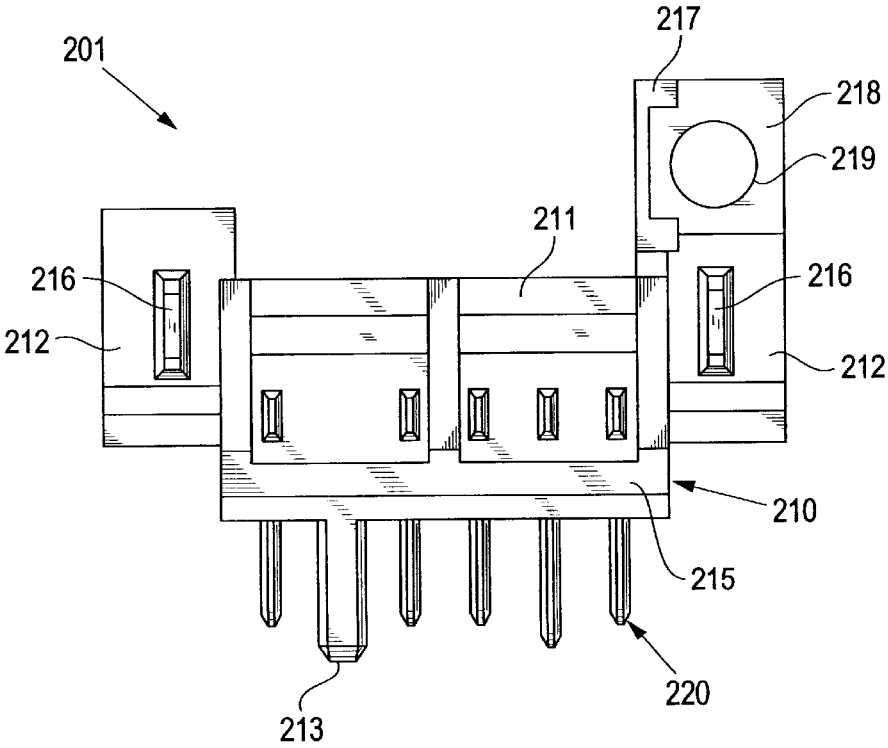
FIG. 9 is a plan view of the electrical connector shown in FIG. 8.
Figure 10:
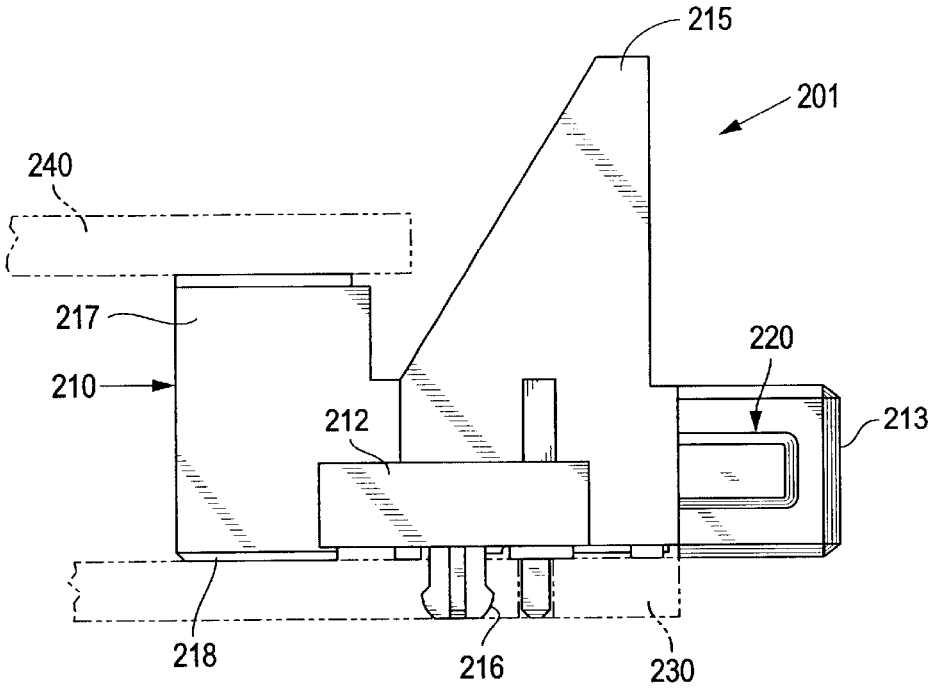
FIG. 10 is a side view of the electrical connector shown in FIG. 8.
Figure 11:
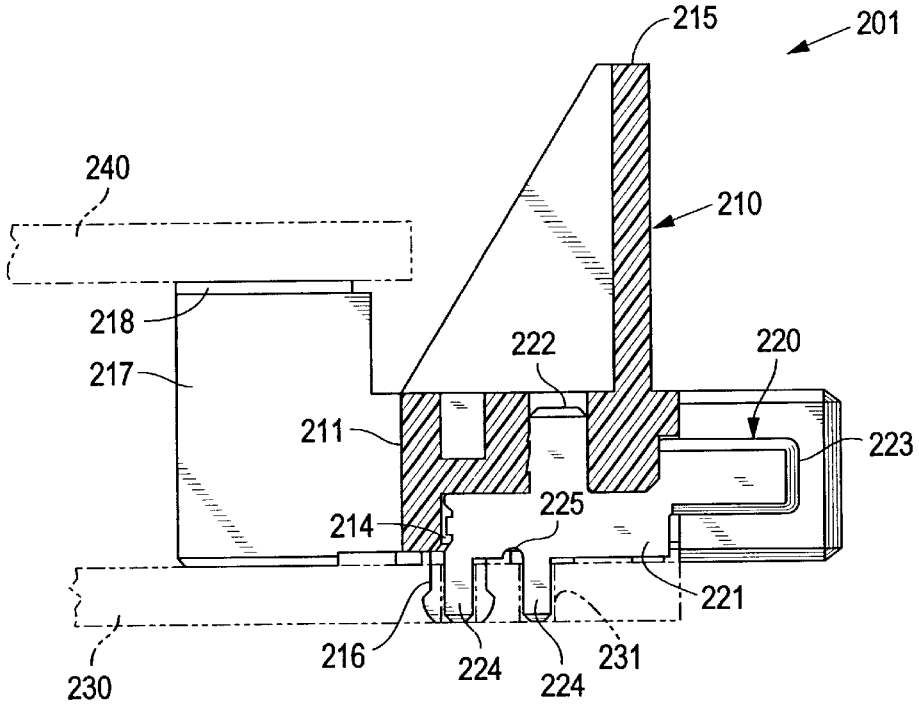
FIG. 11 is a sectional view taken along line 11—11 in FIG. 8. However, the contacts are not shown in section in FIG. 11.

Referring again to FIG. 5, the respective contacts 20 are formed by stamping metal plates, and equipped with a base part 21, a press-fitting fastening part 22 which extends upward from the upper edge of the base part 21, a contact part 23 which extends forward from the front edge of the base part 21 and which contacts a mating contact 42 (shown in FIG. 6), and a solder connection part 24 which extends downward from the rear end portion of the bottom edge of the base part 21. The press-fitting fastening part 22 of each contact 20 is fastened by press-fitting to a fastening attachment part 14*b* from the bottom surface lid of the contact mounting part 11 of the housing 10 along a direction (i.e., the direction indicated by arrow A in FIG. 5) perpendicular to the engagement direction (i.e., the direction indicated by arrow B in FIG. 5) of the mating connector 40. The press-fitting fastening part 22 has a plurality of barbs 22*a* on its rear edge; these barbs 22*a* bite into the side walls of the fastening attachment part 14*b* at the time of fastening by press-fitting. When the press-fitting fastening part 22 of each contact 20 is fastened to the fastening attachment part 14*b* by press-fitting, the base part 21 is accommodated inside the base accommodating part 14*a*, and the contact part 23 protrudes forward from the front surface 11*a* of the contact mounting part 11. Furthermore, the solder connection part 24 protrudes downward from the bottom surface 11*d* of the contact mounting part 11. Moreover, substantially the entire rear edge of the contact 20 on the opposite side from the contact part 23, i.e., the rear edge of the base part 21, the rear edge of the press-fitting fastening part 22, and substantially the entire rear edge of the solder connection part 24, are covered by the contact mounting part 11. A plurality of solder connection inspection recesses 15 which are located in positions corresponding to the solder connection parts 24 of the respective contacts 20, and which extend from the rear surface 11*b* of the contact mounting part 11 to the front surface 11*a* of the contact mounting part 11, are formed in the bottom surface lid of the contact mounting part 11 of the housing 10. Accordingly, even though substantially the entire rear edge of the solder connection parts 24 is covered by the contact mounting part 11, the conditions of the soldering connection of the solder connection parts 24 can be inspected from the side of the rear surface 11*b* of the contact mounting part 11 via the solder connection inspection recesses As is shown in FIG. 6, the electrical connector 1 is mounted on the circuit board 30 when the positioning bosses 12*a* are inserted into the positioning holes 31 of the circuit board 30, and the solder connection parts 24 of the contacts 20 are inserted into the through-holes 32 of the circuit board 30 and connected by soldering. Furthermore, the mating connector 40 is equipped with an insulating housing 41 and a plurality of mating contacts 42 which are attached to this housing 41. This mating connector 40 is engaged with the electrical connector 1 parallel to the circuit board 30. The respective mating contacts 42 have two elastic contact parts 43 that make contact at two points so that both opposite major surfaces of the contact parts 23 of the contacts 20 of the electrical connector 1 are clamped from the left and right. When the electrical connector 1 and mating connector 40 are engaged, the elastic contact parts 43 of the mating contacts 42 of the mating connector 40 contact both opposite major surfaces of the contact parts 23 of the contacts 20 in a direction extending from the front surface 11*a* of the contact mounting part 11 toward the rear surface 11*b* of the contact mounting part 11. As a result, the contact force of the mating contacts 42 with respect to the contacts 20 is greater than the contact force with which an electrical connector having a single elastic contact part of each mating contact would produce when engaging a contact part of a corresponding contact. Therefore, rearward movement of the contacts 20 with respect to the housing 10 would be more likely to occur when mating with an electrical connector having contacts with two elastic contact parts. However, since the press-fitting fastening parts 22 of the respective contacts 20 are fastened by press-fitting to the fastening attachment parts 14*b* from the bottom surface 11*d* of the contact mounting part 11 of the housing 10 along a direction (i.e., the direction indicated by arrow A in FIG. 5) perpendicular to the engagement direction (i.e., the direction indicated by arrow B in FIG. 5) of the mating connector 40, the press-fitting fastening parts 22 do not move toward the rear of the housing 10, so that the contacts 20 do not slip out of the housing 10. Furthermore, since substantially the entire rear edge of each contact 20 on the opposite side of the contact 20 from the contact part 23, i.e., the rear edge of the base part 21, the rear edge of the press-fitting fastening part 22 and substantially the entire rear edge of the solder connection part 24, are covered by the contact mounting part 11, the contacts 20 are not exposed to the rear of the contact mounting part 11, so that there is no possibility of short-circuiting of adjacent contacts 20 by dirt or other members, e.g., housing bodies or electrical parts such as resistors, etc., after the solder connection parts 24 have been connected to the circuit board 30 by soldering.

Another embodiment of the present invention will be described with reference to FIGS. 8 through 11. In FIGS. 8 through 11, the electrical connector 201, like the electrical connector 1, shown in FIGS. 1 through 7, is equipped with an insulating housing 210 which is mounted on a circuit board 230, and a plurality of contacts 220 which are attached to the housing 210. The housing 210 is equipped with a contact mounting part 211 which has substantially the shape of a rectangular solid, and a pair of board fastening parts 212 which protrude from both side surfaces of the contact mounting part 211. As in the case of the housing 10 shown in FIGS. 1 through 7, a polarity rib 213, which prevents backward insertion of the electrical connector 201, and a plurality of contact accommodating holes 214, are formed in the contact mounting part 211. The contact mounting part 211 differs from the housing 10 in that an opening-blocking plate part 215 which protrudes upward from the front end of the upper surface of the contact mounting part 211 is disposed on the front end of the upper surface. This opening-blocking plate part 215 blocks the opening that is formed between the electrical connector 201 and the housing body of a personal computer, etc., when the electrical connector 201 is attached to such a housing body. Metal fastening legs 216 which are used to fasten the electrical connector 201 to the circuit board 230 are disposed on each of the board fastening parts 212. Furthermore, a board carrying part 217 on which a circuit board 240 that is separate from the circuit board 230 is carried is disposed on the rear part of one of the board fastening parts 212, and a metal part 218 which establishes electrical continuity between the ground path of the circuit board 230 and the ground path of the circuit board 240 is attached to this board carrying part 217. Screw holes 219 through which a screw (not shown in the figures) used for mutual fastening of the circuit boards 230 and 240 is passed are formed in the board carrying part 217 and metal part 218.

Next, like the contacts 20 shown in FIGS. 1 through 7, the respective contacts 220 each have a base part 221, a press-fitting fastening part 222 which extends upward from the upper edge of the base part 221, and a contact part 223 which extends forward from the front edge of the base part 221, and which contacts a mating contact. These contacts differ from the contacts 20 in that two solder connection parts 224 which extend downward from the rear end part and roughly the central portion of the base part 221 are formed on the bottom edge of the base part 221. These two solder connection parts 224 are connected by soldering to through-holes 231 formed in the circuit board 230. Accordingly, compared to the contacts 20 in which a single solder connection part 24 is connected by soldering to the circuit board 30, the contacts 220 are structurally stronger, so that even in cases where an excessive load is applied to the electrical connector 201 in the vertical direction, there is no deformation. Furthermore, the contacts 220 differ from the contacts 20 in that a cut-out 225 is formed in the root portion of the solder connection part 224 located in roughly the central portion of the contact 220. When this solder connection part 224 is connected by soldering to the circuit board 230, the solder that flows out accumulates in the cut-out 225, so that no solder flows to the outside. Furthermore, like the press-fitting fastening parts 22 of the contacts 20 shown in FIGS. 1 through 7, the press-fitting fastening parts 222 of the respective contacts 220 are fastened by press-fitting from the bottom surface of the contact mounting part 211 of the housing 210 along a direction perpendicular to the engagement direction of the mating connector. Moreover, substantially the entire rear edge of each contact 220 on the opposite side of the contact 220 from the contact part 223, i.e., the rear edge of the base part 221, the rear edge of the press-fitting fastening part 222 and substantially the entire rear edge of each solder connection part 224, are covered by the contact mounting part 211.

An advantage of the present invention is that the press-fitting fastening parts of the contacts are fastened to the housing by press-fitting from the bottom side of the housing in a direction perpendicular to the engagement direction of the mating connector. Accordingly, even in cases where the contact force of the mating contacts is large, the press-fitting fastening parts do not move toward the rear of the housing, which is the direction of engagement of the mating connector, so that the contacts do not slip out of the housing. Furthermore, since substantially the entire rear edge of each contact on the opposite side of the contact from the contact part is covered by the housing, the contacts are not exposed to the rear of the housing, so that there is no short-circuiting of adjacent contacts by dirt or other members, e.g., housing bodies or electrical parts such as resistors, etc.

Furthermore, since each of the contacts has a solder connection part that is connected to a through-hole in the circuit board by soldering, and since solder connection inspection recesses that extend from the rear surface of the housing to the front surface of the housing are formed in the bottom surface of the housing in positions corresponding to the solder connection parts of the respective contacts, the conditions of the solder connections of the solder connection parts can be inspected from the side of the rear surface of the housing via the solder connection inspection recesses even though substantially the entire rear edge of each solder connection part is covered by the housing.

What is claimed is:

1. An electrical connector for mounting to a circuit board and which is mateable with a mating connector in a direction parallel to the circuit board, the electrical connector comprising:

an insulating housing; and a plurality of contacts mounted in the housing, wherein each contact has a press-fitting part and a contact part positioned forward of the press-fitting part, the press-fitting part extending in a direction which is essentially perpendicular to the longitudinal axis of the contact part, each contact being mateable with a mating contact of the mating connector, barbs extend from the press-fitting parts, the barbs cooperate with and deform side walls of the insulating housing to maintain the contacts in the housing, wherein the press-fitting parts of the contacts are fastened to the housing by press-fitting from a bottom side of the housing proximate the circuit board along a direction perpendicular to the direction of engagement of the mating connector, and wherein substantially an entire rear edge of each of the contacts is covered by the housing.

2. The electrical connector of claim 1, wherein each of the contacts has a solder connection part which is soldered to the circuit board, and solder connection inspection recesses are formed in the bottom surface of the housing extending from a rear surface of the housing to a front surface of the housing, and located in positions corresponding to the solder connection parts of the contacts.

* * * * *